US006910249B2

(12) United States Patent
Leinders

(10) Patent No.: US 6,910,249 B2
(45) Date of Patent: Jun. 28, 2005

(54) APPARATUS ON A DRAW FRAME FOR TEXTILE FIBRE MATERIAL

(75) Inventor: Christoph Leinders, Korschenbroich (DE)

(73) Assignee: Trutzchler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 10/627,988

(22) Filed: Jul. 28, 2003

(65) Prior Publication Data

US 2004/0049888 A1 Mar. 18, 2004

(30) Foreign Application Priority Data

Jul. 29, 2002 (DE) ..... 102 34 414
Jul. 11, 2003 (DE) ..... 103 31 468

(51) Int. Cl.[7] ..... D01H 5/46
(52) U.S. Cl. ..... 19/266
(58) Field of Search ..... 19/236, 258, 260, 19/261, 266, 267, 271, 272, 273, 278, 294, 295

(56) References Cited

U.S. PATENT DOCUMENTS 3,079,648 A * 3/1963 Schiltknecht ..... 19/295
3,143,772 A * 8/1964 Whitehurst ..... 19/272
4,510,648 A * 4/1985 Mori et al. ..... 19/266
5,613,280 A * 3/1997 Mandl ..... 19/239
5,799,374 A * 9/1998 Strobel et al. ..... 19/274
5,953,793 A 9/1999 Röder
6,134,752 A * 10/2000 Gohler et al. ..... 19/272
6,154,931 A * 12/2000 Corrales ..... 19/267

FOREIGN PATENT DOCUMENTS

| | | |
|---|---|---|
| DE | 1 007 634 | 10/1957 |
| DE | 1 038 465 | 9/1958 |
| DE | 195 48 840 A1 | 7/1997 |
| DE | 197 04 815 A1 | 8/1998 |
| GB | 693252 | 6/1953 |

* cited by examiner

*Primary Examiner*—Gary L. Welch
(74) *Attorney, Agent, or Firm*—Venable LLP; Robert Kinberg

(57) ABSTRACT

An apparatus on a draw frame for textile fiber slivers has a drawing system having weighting of the top rollers of successively arranged pairs of rollers comprising a bottom and a top roller. During operation, the top rollers are pressed against the bottom rollers by weighted pressure elements in pressure arms. Two pressure elements with a common holding element are associated with each top roller and the weighting device is removable. To improve the said apparatus, a pressure element is rotatably or pivotally mounted at a center of rotation or a pivot bearing and the pressure elements are connected with one another by a supporting element.

47 Claims, 9 Drawing Sheets

Section K-K

Section L-L

APPARATUS ON A DRAW FRAME FOR TEXTILE FIBRE MATERIAL

CROSS REFERENCE TO RELATED APPLICATION

This application claims the priority of Germany Application No. 102 34 414.0, filed Jul. 29, 2002, and German Application No. 103 31 468.7, filed Jul. 11, 2003, which are incorporated herein by reference.

BACKGROUND OF THE INVENTION

The invention relates to an apparatus on a draw frame for textile fibre slivers.

It is known to weight the top rollers of a drawing system of successively arranged pairs of rollers comprising a bottom and a top roller, in which, during operation, the top rollers are pressed against the bottom rollers by weighted pressure elements in pressure arms, wherein two pressure elements with a common holding element are associated with each top roller and the weighting device is removable.

In a known apparatus, a pressure arm comprising two lateral supports with a common crosshead is associated with each top roller. A pneumatic pressure-applying element is mounted on each lateral support. The pressure arm is rotatable about a pivot bearing, which is provided at the lower end of one lateral support and is secured to the machine frame by way of a press member. A pneumatic compressed air line is located inside the crosshead and the lateral supports.

It is an aim of the invention to further improve the known apparatus.

SUMMARY OF THE INVENTION

The invention provides an apparatus on a draw frame for textile fibre slivers, having a drawing system having successively arranged pairs of rollers comprising a bottom and a top roller, in which, during operation, the top rollers are pressed against the bottom rollers by one or more removable weighted pressure devices, wherein at least one said pressure device for weighting a said top roller has two or more pressure elements, a said pressure element being rotatably or pivotally mounted at a centre of rotation or a pivot bearing and the pressure elements being connected with one another by a supporting element.

The invention also provides a drawing system for a draw frame, comprising successively arranged pairs of rollers comprising a bottom roller and a top roller and a weighting device for applying pressure to a top roller of a said pair of rollers, the weighting device comprising a pair of spaced pressure elements and a support element extending between said pressure elements, said pressure elements comprising structural members of said weighting device.

The fact that the pressure elements and the pressure channel are able to be used as supporting structural elements enables the apparatus according to the invention to be of compact construction. In particular, savings in space can be made both in the direction of the flow of the fibre material and in headroom.

The pressure element advantageously comprises a reciprocating part, for example, a ram. The ram preferably has a circular cross-section. The pressure elements are advantageously pneumatic cylinders. The pneumatic cylinder preferably has a rectangular cross-section. The width of the pneumatic cylinder is advantageously the same as or smaller than the width or the diameter of the top roller. The pneumatic cylinder is preferably a supporting element of the pressure arm. The pneumatic cylinder is advantageously mounted at the centre of rotation or pivot bearing. The centre of rotation or pivot bearing is advantageously mounted in the region of the lower end of the pneumatic cylinder facing the top rollers. The pneumatic cylinder preferably has a covering. The centre of rotation and pivot bearing is advantageously arranged on the lower covering of a pneumatic cylinder. The supporting element is preferably mounted in the region of the upper end of the pneumatic cylinders remote from the top rollers. The supporting element preferably forms the upper covering of the pneumatic cylinders of a pressure arm. The supporting element advantageously forms a bridge between the pneumatic cylinders of a pressure arm. The supporting element advantageously forms a crosshead for the two pneumatic cylinders. The supporting element is advantageously hollow inside. The supporting element preferably forms a compressed air channel. The pneumatic cylinders are advantageously connected to the compressed air channel. The pneumatic cylinders and the supporting element preferably form a portal-form pressure arm. The supporting element advantageously accommodates electrical leads. The pressure arm is preferably arranged in the same plane as the top roller. The longitudinal axis of the supporting element is preferably arranged parallel to the longitudinal axes of the respective top roller. The pneumatic cylinders are advantageously arranged perpendicular to the top roller. The pneumatic cylinders are preferably arranged perpendicular to the supporting element. The supporting element is advantageously an extruded section, for example, of aluminium. The lower covering of a pneumatic cylinder is preferably rotatably mounted at a pivot bearing. A locking device is advantageously associated with the respective other pneumatic cylinder. A locking device is preferably associated with the lower covering of the respective other pneumatic cylinder. At each pressure arm advantageously a pneumatic cylinder or its lower covering is articulated at a pivot bearing. At each pressure arm a locking device is preferably associated with a pneumatic cylinder or its lower covering.

DESCRIPTION OF THE PREFERRED EMBODIMENTS

Figure 1:
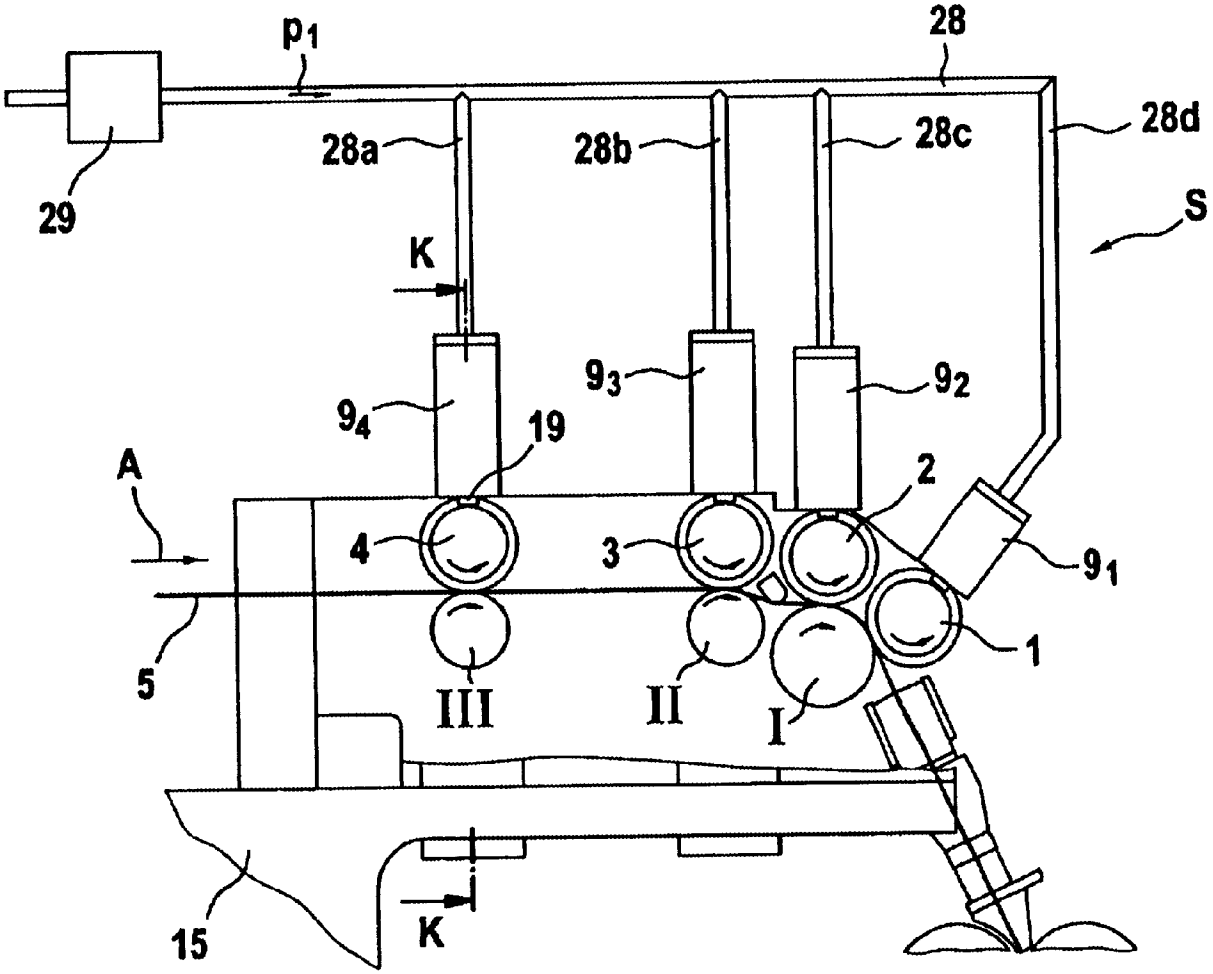
FIG. 1 a schematic side view of the drawing system of a draw frame with the apparatus according to the invention.

With reference to FIG. 1, a drawing system S of a draw frame, for example, a HSR draw frame made by Trützschler GmbH & Co KG of Mönchengladbach, Germany, is provided. The drawing system S is designed as a 4-over-3 drawing system, that is, it comprises three bottom rollers I, II, III (I being the bottom output roller, II the middle bottom roller, III the bottom intake roller) and four top rollers 1, 2, 3, 4. Drafting of the composite sliver 5 from a plurality of fibre slivers takes place in the drawing system S. The draft is made up from the preliminary draft and the main draft, and the roller pairs 4/III and 3/II form the preliminary drafting zone and the roller pairs 3/II and 1, 2/I form the main drafting zone. The bottom output roller I is driven by the main motor (not shown) and hence determines the rate of delivery. The bottom intake and middle bottom rollers III and II respectively are driven by a variable speed motor (not shown). The top rollers 1 to 4 are pressed against the bottom rollers I, II, III by pressure devices $\mathbf{9}_1$ to $\mathbf{9}_4$ (weighting devices) in pressure arms 11*a* to 11*d* pivotable about pivot bearings (see FIGS. 3 and 4), and are hence driven by way of frictional engagement. The direction of rotation of the rollers I, II, II; 1, 2, 3, 4 is indicated by curved arrows. The composite fibre sliver 5, which consists of a plurality of fibre slivers, runs in direction A. The bottom rollers I, II, III are mounted in press member 14 (see FIG. 3) which are arranged on the machine frame 15.

Figure 2:
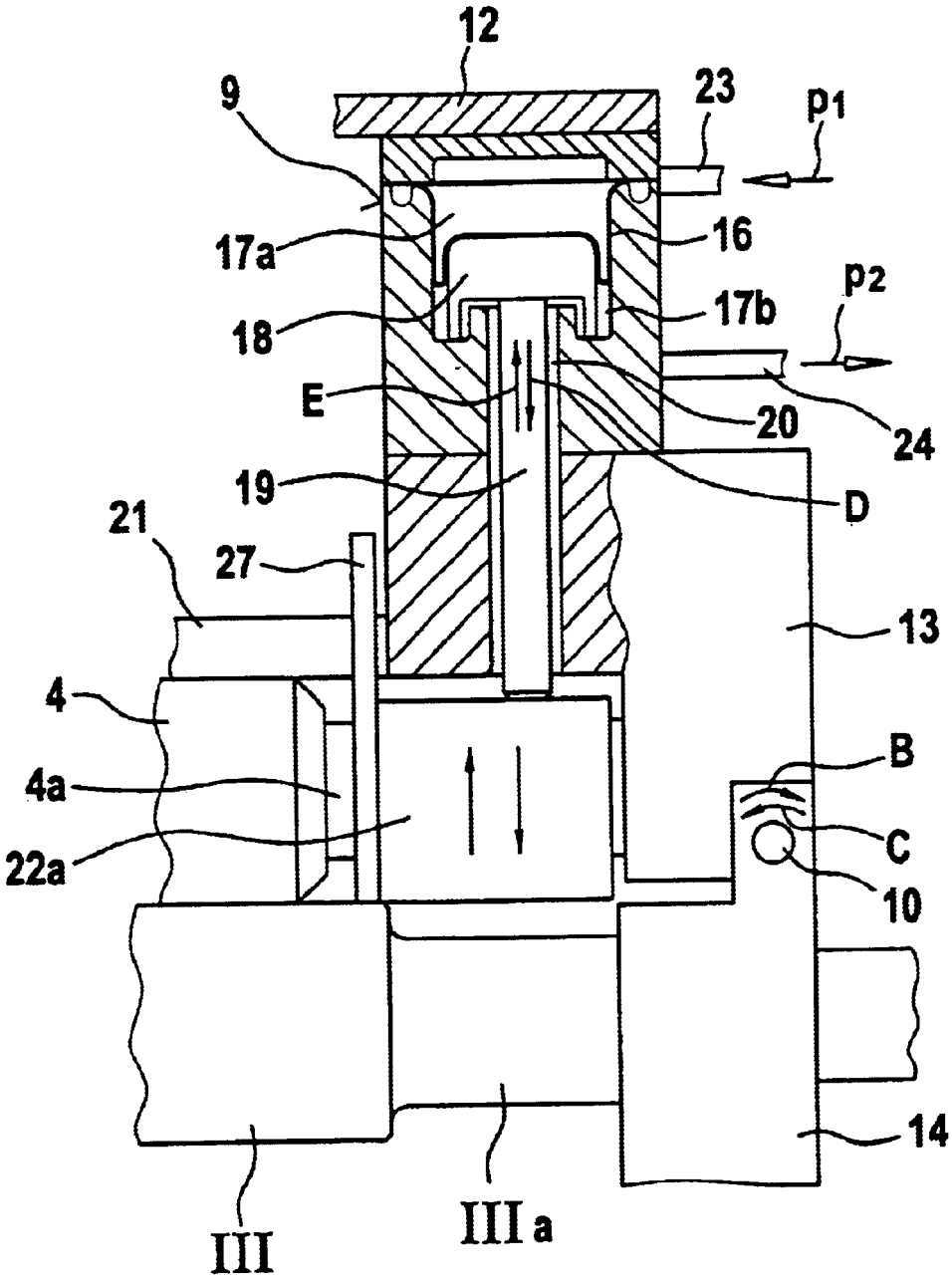
FIG. 2 a section through a portion of FIG. 1 corresponding to I—I (FIG. 1) with a pneumatic top roller weighting device.

Referring to FIG. 2, the pressure device $\mathbf{9}_4$ has a pneumatic cylinder 9 comprising an upper cover (supporting element 12) and a lower cover 13*a*. The pneumatic cylinder 9 forms a cylinder unit having a cylinder cavity 17 comprising two parts 17*a* and 17*b*, in which a piston 18 is guided by means of a ram 19 in a sliding bushing 20. The roller journal 4*a* of the pressure roller 4 passes right through an opening in a holding plate 27 and engages in a bearing 22*a*. The bearing 22*a* receiving the pressure roller 4 extends in a space between the ram 19 and the roller journal III*a* of the bottom roller III. The bearing 22*a* is mounted on the cover 13. A diaphragm 16 divides the cylinder cavity 17 into pressure regions. In order to generate pressure in the upper part 17*a* of the cylinder cavity 17, compressed air $p_1$ can be admitted to this space by means of a compressed air connection 23. Air is evacuated from the lower part 17*b* of the cylinder cavity 17 through a vent bore 24. Analogously, air can be evacuated from the upper part of the cylinder cavity 17 and compressed air can be admitted to the lower part of the cylinder cavity 17. In operation, after a fibre sliver 5 has been guided over the bottom rollers I, II, III, the pressure arms 11 are pivoted into the working position shown in FIG. 1 and fixed in this position by a fixing device (not shown), so that the pressure rollers I, II, III are able to exert pressure. Application of pressure occurs on the one hand as a consequence of each of the rams 19 being located on the corresponding bearing 22, and on the other hand in that an overpressure is generated in the void above the diaphragm 16. The ram 19 therefore presses with its other end on the bearing 22, in order to generate the said clamping between the top roller 4 and the bottom roller (drive roller III). The ram 19 is displaceable in the direction of the arrows D, E.

Figure 3:
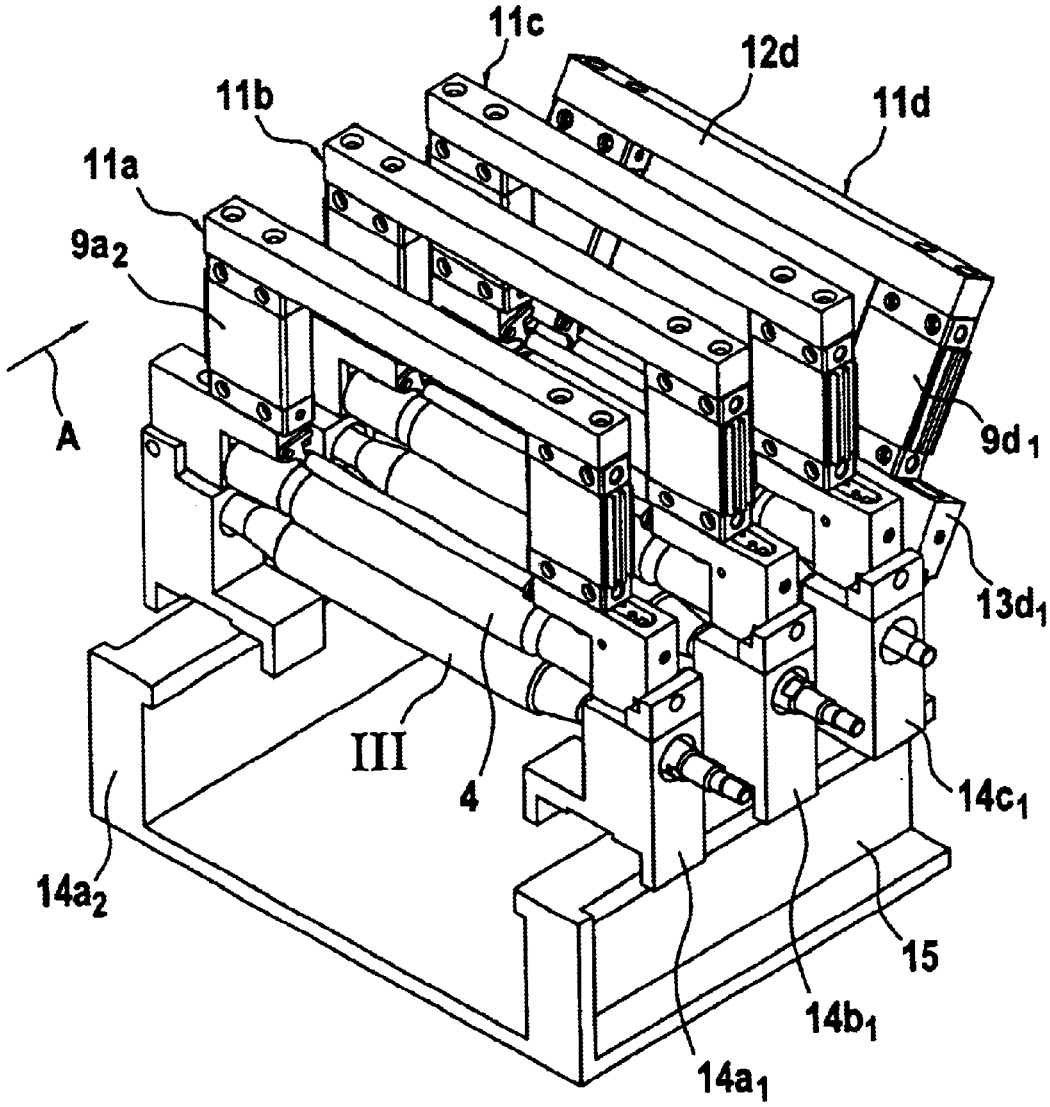
FIG. 3 a perspective view of the drawing system with four portal-form pressure arms, which are associated with the top rollers of the drawing system.

In the embodiment of FIG. 3, each top roller 1 to 4 has associated with it a respective portal-form pressure arm 11*a*, 11*b*, 11*c*, 11*d*, which, seen in plan view, is oriented parallel to the longitudinal axis of the respective top roller 1 to 4. The pressure arms 11*a* to 11*d* are shown in the closed position. The bottom rollers I to III are mounted in press members 14*a*, 14*b* and 14*c* respectively, which are displaceably mounted on the machine frame 15. At the same time, two pressure elements 9 ($\mathbf{9}a_1$ and $\mathbf{9}a_2$; to $\mathbf{9}d_1$ and $\mathbf{9}d_2$), are associated with each top roller 1 to 4 and are connected with one another by a common supporting element 12.

Figure 4:
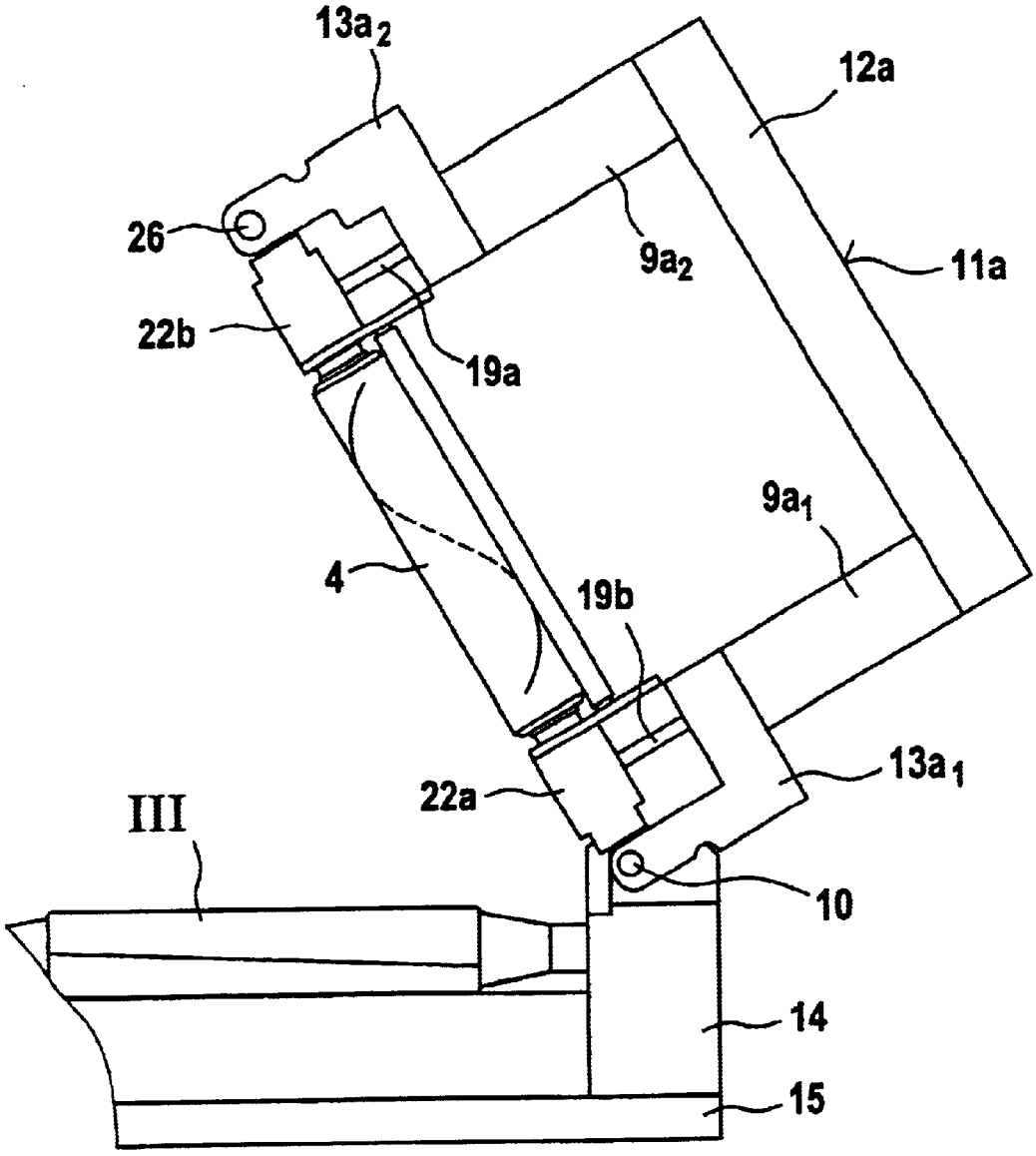
FIG. 4 a front view of the apparatus according to the invention, in which the portal-form pressure arm with top roller swung out.

According to FIG. 4, the portal-form pressure arm 11*a*, which consists of two lateral pneumatic cylinders $\mathbf{9}a_1$ and $\mathbf{9}a_2$ (pressure elements), a common supporting element 12*a* and two cover elements $\mathbf{13}a_1$ and $\mathbf{13}a_2$, is associated with the top roller 4. The cover elements $\mathbf{13}a_1$ and $\mathbf{13}a_2$ are mounted at the lower ends of the pneumatic cylinders $\mathbf{9}a_1$ and $\mathbf{9}a_2$ and form the lower cover thereof. The supporting element 12*a* is mounted at the upper ends of the pneumatic cylinders $\mathbf{9}a_1$ and $\mathbf{9}a_2$ and forms their upper cover. Together with the top roller 4, the pressure arm 11*a* is upwardly pivoted about a pivot bearing 10 (see FIG. 5). The cover elements $\mathbf{13}a_1$ and $\mathbf{13}a_2$ are, seen in side view, of angular (right-angled) construction, one arm of the angle covering a respective pneumatic cylinder $\mathbf{9}a_1$, $\mathbf{9}a_2$. The other angle arm of the cover element $\mathbf{13}a_1$ is rotatably mounted in the region of its free end at the pivot bearing 10. The other angle arm of the cover element $\mathbf{13}a_2$ has a locking device in the region of its free end, the locking device comprising an aperture 26, through which a sliding locking rod (not shown) mounted on the machine frame 15 engages. The pressure arm 11*a* is shown in the opened position.

Figure 5:
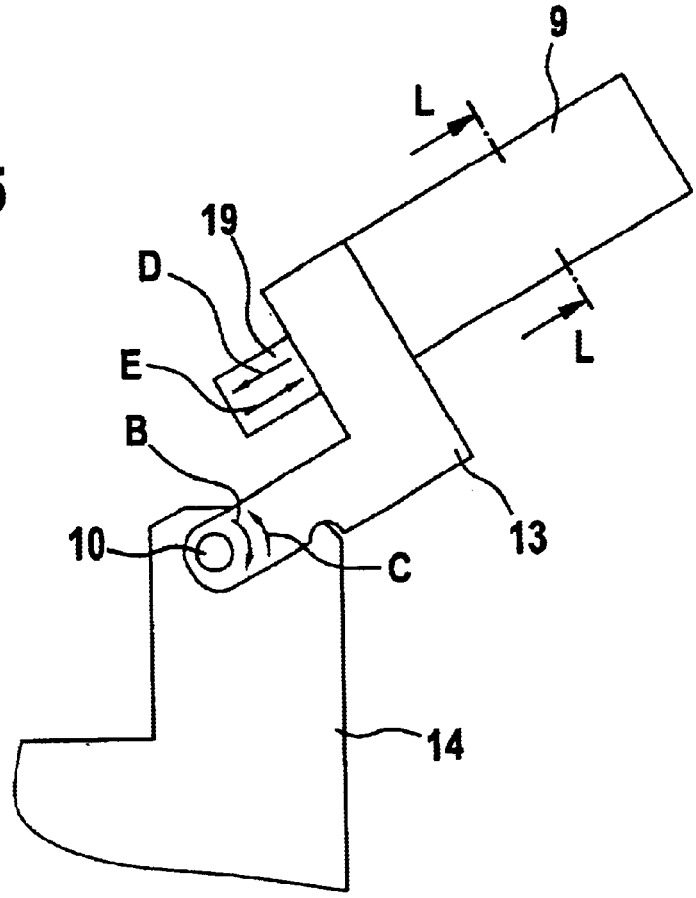
FIG. 5 a pneumatic cylinder, for which the lower covering is articulated at a pivot bearing.
Figure 5A:
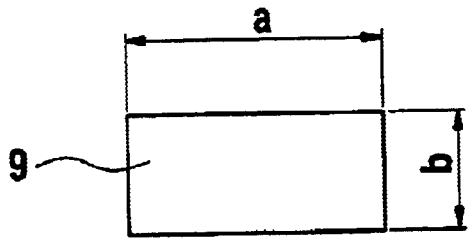
FIG. 5*a* a cross section through a pneumatic cylinder according to FIG. 5.

The embodiment of FIG. 5, the lower cover element 13 of the pneumatic cylinder 9 is articulated on the bearer 14 by way of a pivot bearing 10 so as to rotate in the direction of the arrows B and C.

Figure 6:
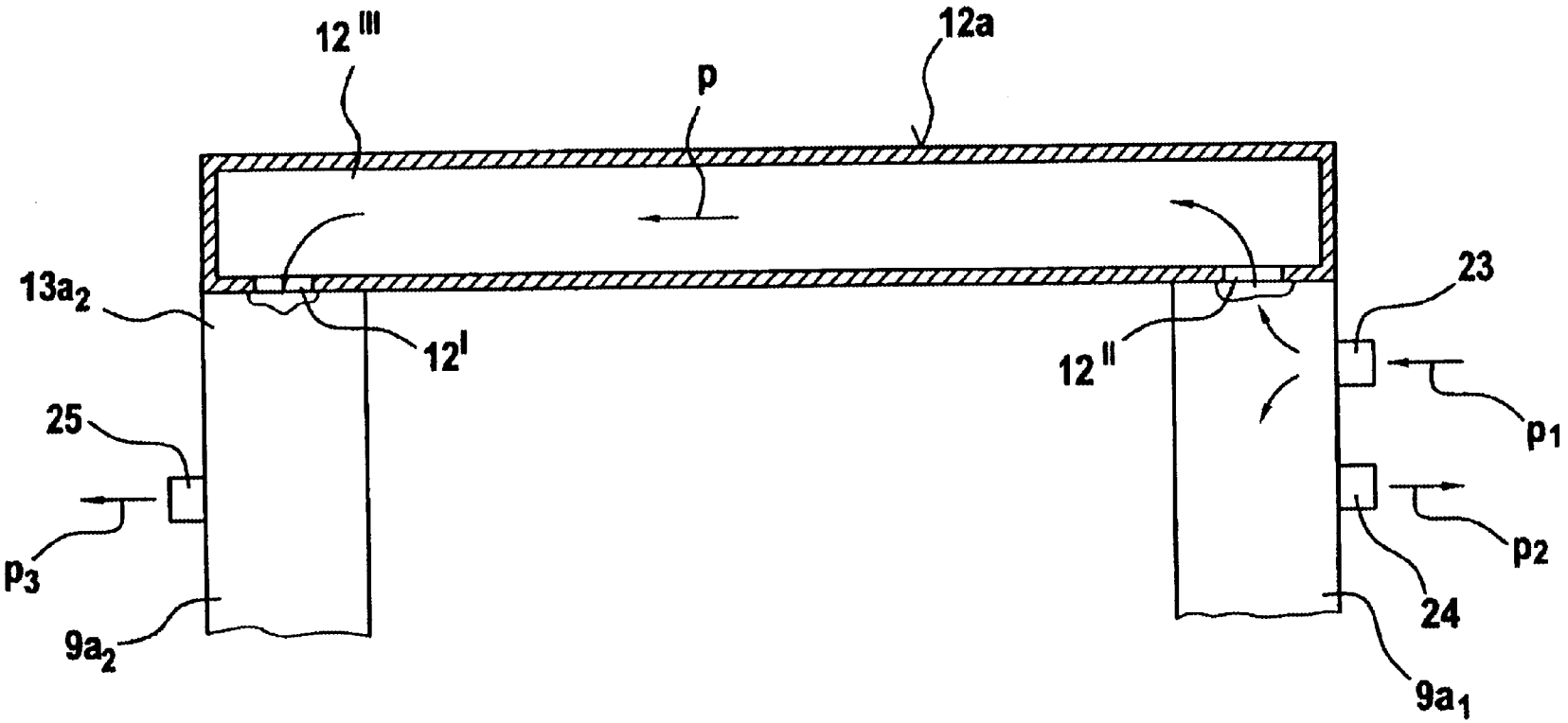
FIG. 6 a schematic longitudinal section through two pneumatic cylinders with supporting element, which takes the form of a compressed air channel.

In a further embodiment shown in FIG. 6, the supporting element 12*a* consists of an extruded section, for example of aluminum, which is hollow inside and the end faces of which are closed. In the end face regions there are two openings 12', 12" in a lateral wall. This creates a channel 12'", through which compressed air p is able to pass. One connection 23 for the admission of compressed air $p_1$ is therefore sufficient, part of the compressed air flowing into the pneumatic cylinder $\mathbf{9}a_1$ and the remainder flowing via the channel 12'" of the supporting member 12*a* into the pneumatic cylinder $\mathbf{9}a_2$. The pneumatic cylinders $\mathbf{9}a_1$ and $\mathbf{9}a_2$ have a respective connection 24 and 25 for discharge of the compressed air $p_2$ and $p_3$ respectively.

As shown in FIG. 1, a central compressed air line 28 is provided, to which four branch lines 28*a* to 28*d* leading to pneumatic cylinders of pressure devices $\mathbf{9}_1$ to $\mathbf{9}_4$ are connected. The compressed air line 28 is connected to a compressed air source 29.

The invention has been explained with reference to an example in which a pivot bearing and a locking device are associated with each pressure arm. The invention also includes a construction in which two combined pivot bearings and locking devices are associated with a pressure arm.

The apparatus according to the invention has been illustrated by way of the example of a draw frame with pneumatic weighting of the top rollers. The invention also includes a draw frame in which the top rollers are loaded mechanically, for example, by springs.

Figure 7:
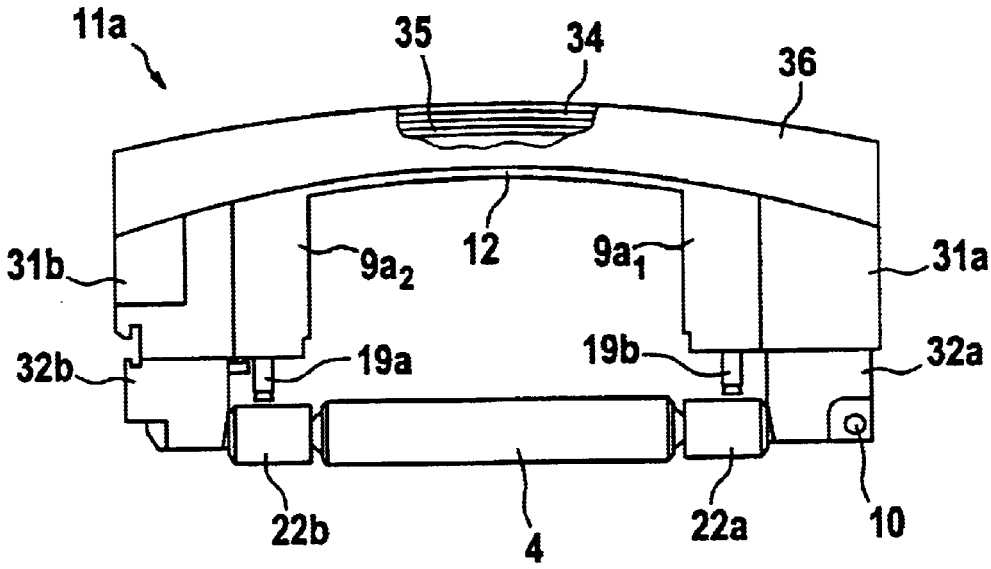
FIG. 7 a front view of a pressure arm with integral housing.
Figure 7A:
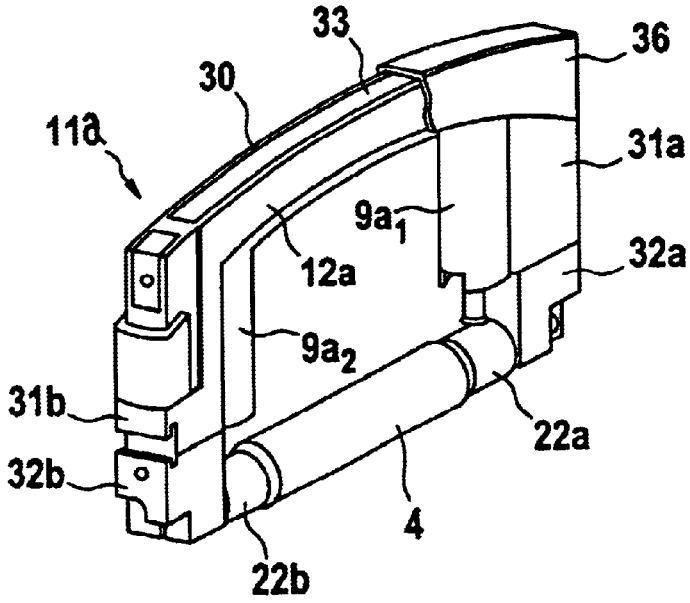
FIG. 7*a* a perspective view of the partially opened housing according to FIG. 7 with lid.

According to FIGS. 7, 7*a*, the portal-form pressure arm 11*a* is associated with the top roller 4. (A corresponding pressure arm 11—not shown herein—is associated with the top rollers 2 to 4.) The pressure arm 11*a* is embodied as housing 30 which is injection-molded of glass-fiber reinforced plastic. The housing 30 is an integral component having a uniform design and comprising the supporting element 12*a,* the two bodies of the pressure elements $9a_1$ and $9a_2$ (pressure cylinders), two intermediate elements 31*a* and 31*b* and 2 holding elements 32*a* and 32*b*. The supporting element 12*a* is designed as a channel that is open on one side, has an approximately U-shaped cross section and has the pneumatic lines 34 and the electric lines 35 arranged on the inside. The open side of channel 34 can be closed off with a removable lid 36 of glass-fiber reinforced plastic having an approximately U-shaped cross section, which is elastic enough, so that it can be pressed against the channel 33 for fastening it. The housing 30 preferably has a one-piece design. The integral housing 30, which combines all essential operational elements for holding and weighting the respective top rollers 1 to 4, can thus be produced economically. At the same time, the complete pressure arm 11*a* to 11*d* can be rotated easily around the pivot bearing 10 and can be locked and unlocked with the locking device 26.

Figure 8A:
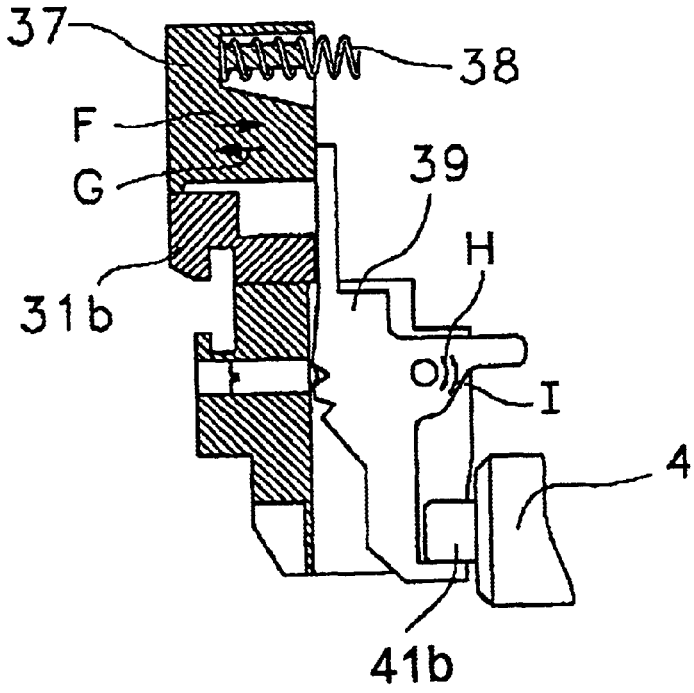
FIGS. 8*a*,8*b* a spring-weighted pressure tracer with rotating double-angle lever and FIGS. 9*a*,9*b* the pressure arm with (FIG. 9*a*) and without top roller (FIG. 9*b*).
Figure 8B:
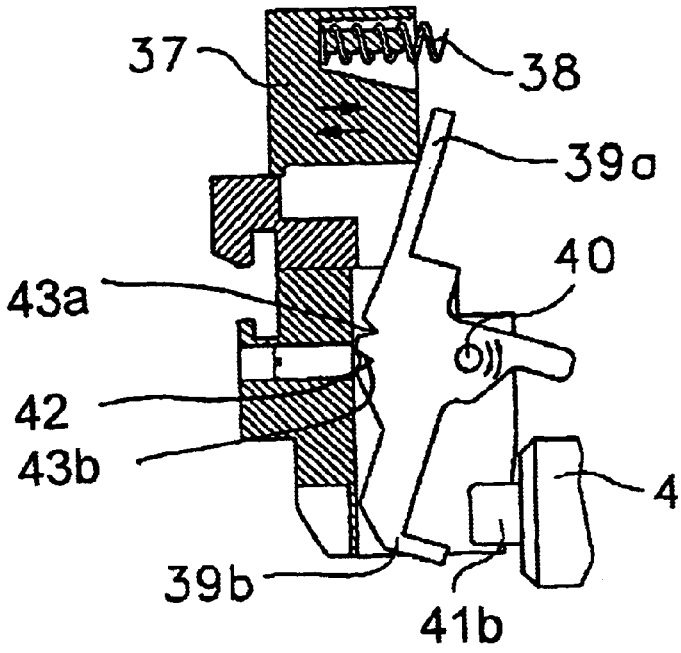
Figure 9A:
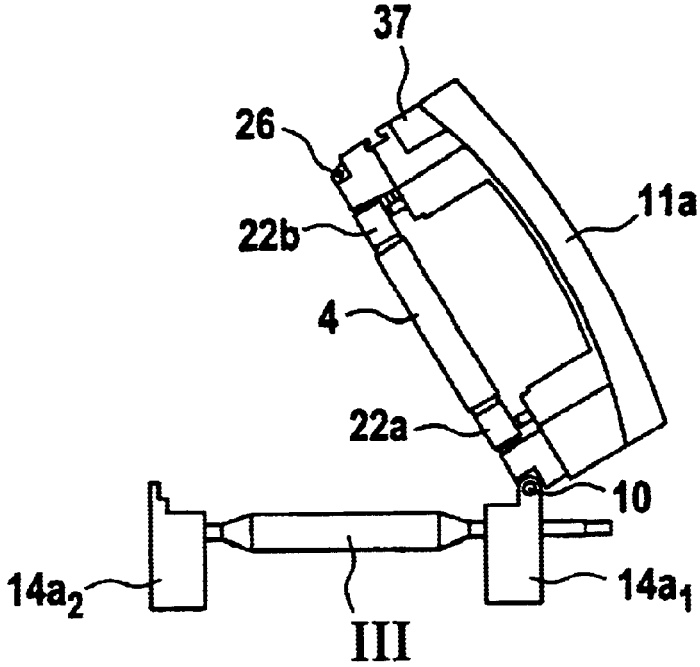
Figure 9B:
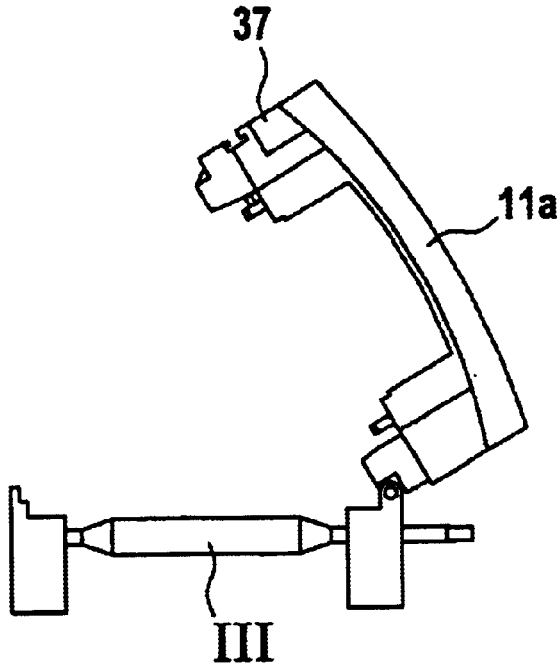

FIGS. 8*a,* 8*b* show that a pressure tracer 37 that is weighted with a compression spring 38 is arranged on the intermediate element 31*b*. The pressure tracer 37 can be displaced in the direction of arrows F, G. A double lever 39 is furthermore mounted on the intermediate element 31*b,* which can pivot around a pivot bearing 40 in the direction of arrows H, I. According to FIG. 8*a,* the portion of angle arm 39*b* that projects at a right angle grips beneath and holds the shaft journal 41*b* of bearing 22*b* for the top roller 4. If the pressure arm 37 according to FIG. 8*b* is pushed in the direction F, against the angle arm 39*a* of the angle lever 39, then the angle arm 39*a* turns in the direction of arrow H around the pivot bearing 40, so that the angle arm 39*b* releases the shaft journal 41*b*. In this way, the top roller 4 with bearings 22*a,* 22*b* can be removed completely from the pressure arm 11*a,* as shown in FIG. 9*b*. FIG. 9*a* shows the pressure arm 11*a* with top roller 4 in the upward pivoted position. Two recesses 43*a,* 43*b* are provided on the double lever 39, wherein an elastically loaded detent 42 or the like engages in these recesses.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An apparatus on a draw frame for textile fiber slivers, having weighted top rollers for the drawing system, the apparatus comprising:

successively arranged pairs of rollers, each pair of rollers having a bottom roller and a top roller;

a plurality of pressure arms, each pressure arm having weighted pressure elements for pressing one of the top rollers against its corresponding bottom roller during operation, each pressure arm being positioned so as to one of rotate and pivot together with its pressure elements around one of a rotating bearing and a pivot bearing; and a plurality of supporting elements, each supporting element being essentially empty and pneumatically connecting the pressure elements associated with one of the top rollers, wherein the pressure elements are removable.

2. An apparatus according to claim 1, in which each pressure element comprises a reciprocating member.

3. An apparatus according to claim 1, wherein each pressure element is a pneumatic cylinder of rectangular cross-section.

4. An apparatus according to claim 3, wherein a pressure device comprises one of the pressure arms, two of the pneumatic cylinders and one of the supporting elements.

5. An apparatus according to claim 4, wherein the pressure device is one of rotatable and pivotable about one of a center of rotation and a pivot bearing associated with a first said pressure element and the apparatus further comprises a locking device in a vicinity of a second said pressure element for locking the pressure device in position on said top roller.

6. An apparatus according to claim 5, wherein said second pressure element has a lower cover element, said locking device being provided on said lower cover element.

7. An apparatus according to claim 1, wherein one of the pressure elements is associated with a first end region of each of the top rollers and another of the pressure elements is associated with a second, opposed, end region of each of the top rollers.

8. An apparatus according to claim 1, wherein said pressure elements structurally support said supporting element.

9. An apparatus according to claim 1, wherein a first pressure element of the pressure elements is mounted at the pivot bearing.

10. An apparatus according to claim 9, wherein the pivot bearing is located in a lower region of the first pressure element.

11. An apparatus according to claim 9, wherein the pivot bearing is located in a lower cover element of the first pressure element.

12. An apparatus according to claim 1, wherein the supporting element is mounted on said pressure elements at or in the vicinity of upper ends of said pressure elements.

13. An apparatus according to claim 1, wherein the supporting element is hollow.

14. An apparatus according to claim 1, wherein the supporting element forms a compressed air channel and the pressure elements are pneumatic cylinders which are in communication with said compressed air channel.

15. An apparatus according to claim 1, wherein the pressure elements are arranged perpendicular to the supporting element.

16. An apparatus according to claim 1, wherein the pressure elements are arranged perpendicular to the top roller.

17. An apparatus according to claim 1, further comprising a portal-shaped pressure arm formed from said pressure elements and said supporting element.

18. An apparatus according to claim 1, wherein the pressure element and the top roller are in a common plane.

19. The apparatus according to claim 1, further comprising a locking and unlocking device for the top roller.

20. The apparatus according to claim 19, wherein the locking and unlocking device is a pressure tracer.

21. The apparatus according to claim 20, wherein the pressure tracer is weighted with a spring element.

22. The apparatus according to claim 21, wherein the spring-weighted pressure tracer cooperates with an angle lever that is pivotable around a bearing.

23. The apparatus according to claim 22, wherein the angle lever is a double angle lever.

24. The apparatus according to claim 23, wherein the pressure tracer acts upon an angle arm of the double angle lever.

25. The apparatus according to claim 24, wherein the top roller acts jointly with other angle arms of the double angle lever.

26. The apparatus according to claim 23, wherein two recesses are provided on the double lever, and an elastically loaded detent engages in one of the recesses depending on a position of double lever.

27. The apparatus according to claim 20, wherein the pressure tracer is manually activatable.

28. The apparatus according to claim 20, further comprising a housing for the pressure arm, the housing having an intermediate element, wherein the pressure tracer is arranged on the intermediate element of the housing.

29. The apparatus according to claim 1, wherein one pressure element is attached to the one of a rotating bearing and a pivot bearing so as to one of rotate and pivot.

30. A drawing system for a draw frame, comprising:

successively arranged pairs of rollers, each pair having a bottom roller and a top roller; and a weighting device for applying pressure to the top roller of a said pair of rollers, the weighting device having a pair of spaced pressure elements and a support element extending between said pressure elements, said pressure elements comprising structural members of said weighting device, wherein said support element is essentially empty and pneumatically connects said pressure elements.

31. A drawing system according to claim 30, wherein the weighting device is pivotably mounted in the vicinity of a first pressure element of said pair of pressure elements.

32. A drawing system according to claim 31, wherein the top roller to which pressure is applied is connected to the weighting device and pivotable therewith.

33. An apparatus on a draw frame for textile fiber slivers, having weighted top rollers for the drawing system, the apparatus comprising:

successively arranged pairs of rollers, each pair of rollers having a bottom roller and a top roller;

a plurality of pressure arms, each pressure arm having weighted pressure elements for pressing one of the top rollers against its corresponding bottom roller during operation, each pressure arm being positioned so as to one of rotate and pivot together with its pressure elements around one of a rotating bearing and a pivot bearing, wherein the pressure elements are removable;

a plurality of supporting elements, each supporting element connecting the pressure elements associated with one of the top rollers, wherein the supporting element comprises a channel that is open on one side and is closable with a removable lid; and further comprising a housing for the pressure arm.

34. The apparatus according to claim 33, wherein the housing comprises plastic.

35. The apparatus according to claim 34, wherein the plastic comprises a fiber-reinforced plastic.

36. The apparatus according to claim 33, wherein the housing is an injection-molded housing.

37. The apparatus according to claim 33, wherein the housing is an integral component.

38. The apparatus according to claim 33, wherein the housing comprises the supporting element.

39. The apparatus according to claim 33, further comprising one of electrical lines and pneumatic lines arranged in the channel.

40. The apparatus according to claim 33, wherein the housing comprises the pressure elements.

41. The apparatus according to claim 33, wherein the housing comprises two holding elements.

42. The apparatus according to claim 41, wherein respectively one holding element is assigned to an outside of the pressure element.

43. The apparatus according to claim 41, wherein one of the holding elements is attached to the one of a rotating bearing and a pivot bearing, such that it can one of rotate and pivot.

44. The apparatus according to claim 43, wherein the one of the holding elements can be detached from the one of a rotating bearing and a pivot bearing.

45. The apparatus according to claim 43, wherein each pressure element is attached via at least one intermediate element to the one of a rotating bearing and a pivot bearing.

46. The apparatus according to claim 41, further comprising a locking device, wherein the one of the holding elements can be detached from the locking device.

47. The apparatus according to claim 46, wherein each pressure element is fastened detachably with at least one intermediate element to the locking device.

* * * * *